US005129988A

United States Patent [19]

Farrington, Jr.

[11] Patent Number: 5,129,988

[45] Date of Patent: Jul. 14, 1992

[54] EXTENDED FLEXIBLE HEADBOX SLICE WITH PARALLEL FLEXIBLE LIP EXTENSIONS AND EXTENDED INTERNAL DIVIDERS

[75] Inventor: Theodore E. Farrington, Jr., Appleton, Wis.

[73] Assignee: Kimberly-Clark Corporation, Neenah, Wis.

[21] Appl. No.: 718,889

[22] Filed: Jun. 21, 1991

[51] Int. Cl.[5] ..... D21F 1/02

[52] U.S. Cl. ..... 162/123; 162/203; 162/214; 162/301; 162/343; 162/344; 162/347

[58] Field of Search ..... 162/203, 214, 216, 123, 162/301, 336, 343, 344, 347

[56] References Cited

U.S. PATENT DOCUMENTS

| | | | |
|---|---|---|---|
| 3,802,966 | 4/1974 | Delekto et al. | 162/343 |
| 3,954,558 | 4/1976 | Egelhof | 162/344 |
| 4,087,321 | 5/1978 | Schultz | 162/343 |
| 4,125,429 | 11/1978 | Hergert et al. | 162/123 |
| 4,128,455 | 12/1978 | Justus | 162/216 |
| 4,141,788 | 2/1979 | Justus | 162/125 |
| 4,225,382 | 9/1980 | Kearney et al. | 162/111 |
| 4,345,970 | 8/1982 | Redvan et al. | 162/123 |
| 4,376,012 | 3/1983 | Bergstrom | 162/123 |
| 4,376,014 | 3/1983 | Bergstrom | 162/336 |
| 4,381,219 | 4/1983 | Bubik et al. | 162/299 |
| 4,384,922 | 5/1983 | Stotz | 162/343 |
| 4,427,491 | 1/1984 | Radvan et al. | 162/299 |
| 4,436,587 | 3/1984 | Andersson | 162/123 |
| 4,445,974 | 5/1984 | Stenberg | 162/300 |
| 4,543,162 | 9/1985 | Hildebrand | 162/343 |
| 4,563,244 | 1/1986 | Syed et al. | 162/344 |
| 4,565,603 | 1/1986 | Reiner et al. | 162/123 |
| 4,617,091 | 10/1986 | Rodal et al. | 162/343 |

FOREIGN PATENT DOCUMENTS

| | | | |
|---|---|---|---|
| 565496 | 11/1958 | Canada | 162/347 |

*Primary Examiner*—Karen M. Hastings
*Attorney, Agent, or Firm*—Gregory E. Croft

[57] ABSTRACT

The uniformity of layered paper sheets produced using a layered headbox can be improved by confining the outer layers between parallel surfaces within the headbox immediately prior to leaving the headbox.

9 Claims, 5 Drawing Sheets

EXTENDED FLEXIBLE HEADBOX SLICE WITH PARALLEL FLEXIBLE LIP EXTENSIONS AND EXTENDED INTERNAL DIVIDERS

BACKGROUND OF THE INVENTION

In the manufacture of tissue and other paper products, it is often advantageous to form the paper web in distinct layers of different fiber compositions. Layered headboxes having internal dividers are well known in the art for achieving this objective. In some of these layered headboxes the dividers extend outwardly beyond the slice opening of the headbox. In others the dividers fall short of the slice opening. While the headboxes having the extended dividers generally provide improved layer purity, they still suffer drawbacks from the standpoint of outer layer uniformity. This is of particular concern in the manufacture of relatively light basis weight products such as facial and bath tissue, especially in tissue making processes which employ long free jets emanating from the headbox such as twin wire forming processes. Therefore there is a need to improve the design and performance of layered headboxes to provide improved outer layer uniformity.

SUMMARY OF THE INVENTION

It has now been determined that the uniformity of the outer layer of a tissue sheet or web can be improved by confining the outer layer between two substantially parallel surfaces and reducing the length of the free jet emanating from the headbox. It is postulated that undampened turbulence and secondary flows in the outer layer cause the outer layers to blend with the center layers or break up in the free jet, thereby degrading the uniformity of those layers. By dampening this turbulence and eliminating secondary flows with an outer surface which is parallel or substantially parallel to the direction of flow, the formation in the outer layer is improved. Depending on the flexibility of the parallel surfaces and the dynamics of the process, the surfaces may be parallel, slightly converging, or slightly diverging. It is nevertheless believed that their relative angular positions are within about 1° of each other. This invention is particularly advantageous when used in connection with twin wire forming processes, in which the forming zone is defined by converging forming wires, because such formers frequently have long free jets. Also, such formers are often used for making low basis weight products such as facial tissue, bath tissue, paper towels, dinner napkins, and the like, where layer nonuniformities are more evident. Such products have basis weights in the range of from about 5 to about 40 pounds per 2880 square feet per ply.

Hence, in one aspect the invention resides in a method for forming a layered paper web comprising issuing a layered stream of papermaking fibers from a multiple channel headbox into a forming zone, wherein immediately prior to leaving the headbox, at least one of the two outer layers of the layered stream of papermaking fibers is confined between two parallel surfaces. Advantageously, the two parallel surfaces can be the rigid inside surface of the headbox wall and a headbox divider. Preferably, the two parallel surfaces are a flexible headbox lip extension and a flexible extended headbox divider, which in operation will be substantially parallel at steady state due to their flexibility. Particularly in twin wire forming processes, because of space restrictions due to the size of commercial headboxes and the forming zone geometry, the headbox lips can only extend so far into the forming zone defined by the converging forming wires. Hence for purposes of this invention the lip extensions are preferred because they not only dampen the turbulence generated and secondary flows within the headbox, but they can also shorten the free jet length to a greater extent than more cumbersome heavy-walled headbox lips.

In another aspect, the invention resides in a multiple channel papermaking headbox having one or more internal dividers and a slice opening defined by the lips of the headbox walls, wherein during operation at least one of the headbox walls is substantially parallel to an adjacent internal divider, thereby creating a parallel stock flow channel immediately prior to the slice opening.

In a further aspect, the invention resides in an improved multiple channel headbox having converging channels terminating at a slice opening defined by the lips of the headbox walls, the improvement comprising at least one flexible headbox divider which extends beyond the slice opening and at least one flexible headbox lip extension which extends beyond the slice opening and is sufficiently flexible to be substantially parallel to the extended divider during operation of the headbox. It is preferred that the headbox lip extension extend the same distance as the extended headbox divider such that they are substantially coterminous. It is preferred that both headbox lips are provided with headbox lip extensions, although improvements can be achieved with only one headbox lip extension on either the top or the bottom of the headbox.

The extent to which the headbox lip extensions and the extended dividers extend beyond the slice opening can vary depending upon the particular headbox, the operating conditions and the desired results. In general, however, the extensions should be as long as is practical in order to reduce the free jet length to a minimum. Free jets can typically be about 17 inches or more for some commercial headboxes and it has been found that extensions sufficient to reduce the free jet length to about 6 inches or less are sufficient to obtain uniformity improvements in the outer layers. The down side of reducing the free jet too much is the potential for damaging the forming fabrics if they are contacted by any of the headbox components. In all situations, this risk must be balanced against the gains in formation possible by using this invention.

As previously mentioned, the two parallel surfaces, such as the extended dividers and the headbox lip extensions, are preferably substantially coterminous. This means that they extend into or toward the forming zone substantially the same distance. If the two parallel surfaces are of different lengths, it is preferred that the outer surface be the longer of the two in order to reduce the free jet length as much as possible. Preferably any difference in length is less than about 25 percent or less, however, because differences in length can be a source of turbulence formation. It should also be mentioned that the lengths of each pair of parallel surfaces can be different for the top and bottom of the headbox, particularly if the forming zone geometry is not symmetrical.

DETAILED DESCRIPTION OF THE DRAWING

Figure 1:
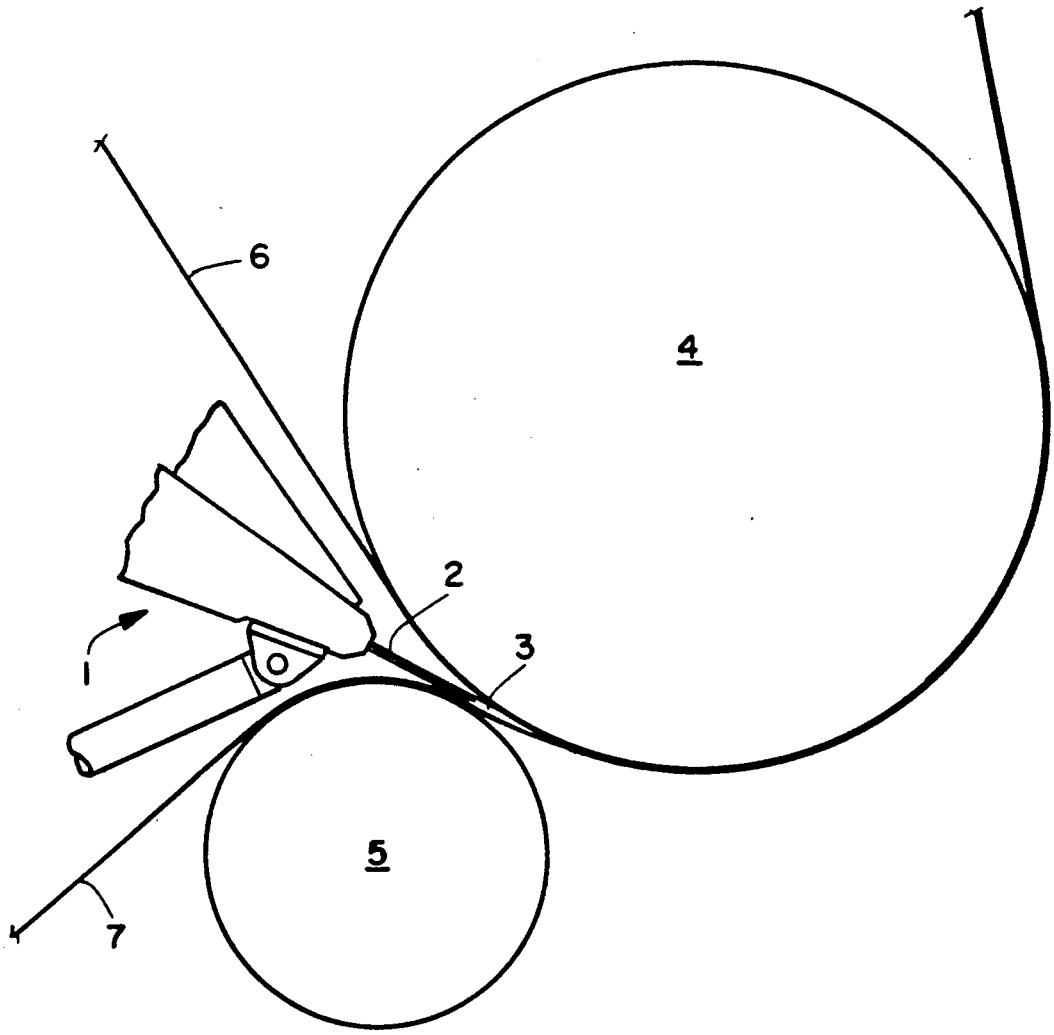
FIG. 1 (PRIOR ART)
FIG. 1 is a cross-sectional schematic of the forming zone of a conventional twin wire tissue making process showing the relationship of the headbox slice opening and the free jet relative to the form roll and the breast roll.

Referring to FIG. 1, a setting for this invention will be described in greater detail. Shown is a typical headbox 1 having extended dividers 2, issuing a free jet 3 of an aqueous suspension of papermaking fibers into the space between converging forming surfaces defined by a forming roll 4 and breast roll 5. The forming roll is partially wrapped by a first forming wire or fabric 6 and the breast roll is partially wrapped by a second forming wire or fabric 7. The free jet, which can be about one inch thick, impacts the forming wire on the forming roll, which may be solid or vacuum assisted. The angle of impingement of the free jet and its point of impact can be different for different processes and forming geometry. The fibers are deposited onto the forming wire while water is removed. If the forming roll is a vacuum roll, water is removed through the wire wrapping the forming roll by vacuum suction and through the wire wrapping the breast roll by forming pressure as the embryonic web is sandwiched between the two wires. The newly-formed wet web is then further processed in any suitable manner to produce a paper or tissue web. Such processing typically includes further dewatering, drying, creping, winding and converting to the desired product form.

Figure 2:
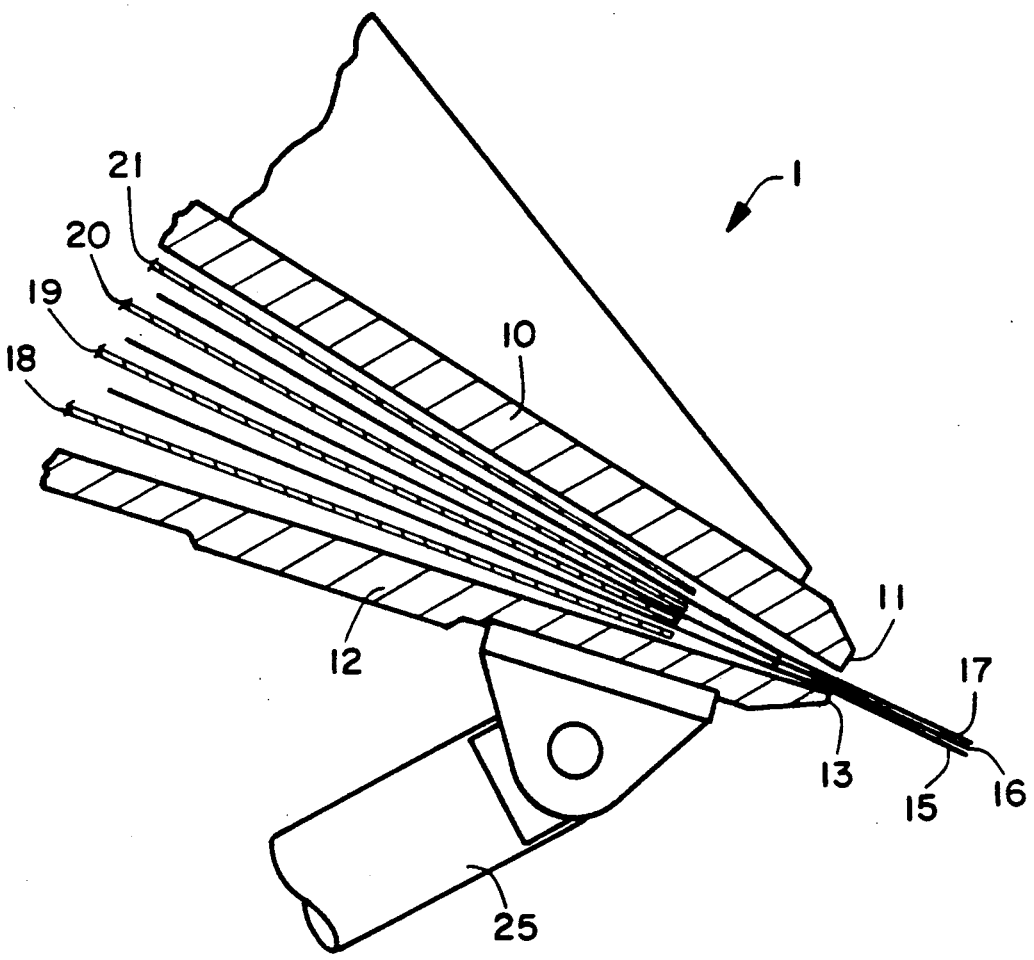
FIG. 2 (PRIOR ART)
FIG. 2 is a cross-sectional view of a prior art multiple channel headbox having extended dividers.

FIG. 2 is a more detailed cross-sectional partial view of a conventional layered headbox 1 having extended dividers as shown in FIG. 1. Shown is the upper headbox wall 10 which ends at the upper headbox lip 11. The lower headbox wall 12 ends at the lower headbox lip 13. The space between the upper headbox lip and the lower headbox lip is sometimes referred to herein as the slice opening. The headbox is ultimately divided into four flow channels by internal headbox dividers 15,16, and 17. Upstream of the slice opening, however, the headbox is further divided into additional flow channels by internal dividers or vanes 18, 19, 20, and 21, which serve to generate fine scale turbulence in the headbox. Because of the required thinness of the extended dividers at their tips, the extended dividers are inherently flexible. The headbox walls, however, are rigid and their relative positions are fixed during operation but can be controllably adjusted by an adjustment means such as the pivotable rod 25 shown attached to the lower headbox lip. Typical angles of convergence for top and bottom headbox walls of commercially available headboxes can be from 15° to 19°. Note that as various feedstocks pass through the multiple flow channels of the headbox, they converge until they reach the region of the slice opening, where all flows quickly transition to substantially parallel. At this point in the process, the outer layers of stock flow are not confined and are free to expand as dictated by any turbulent forces and secondary flows which exist as a result of the upstream conditions.

Figure 3:
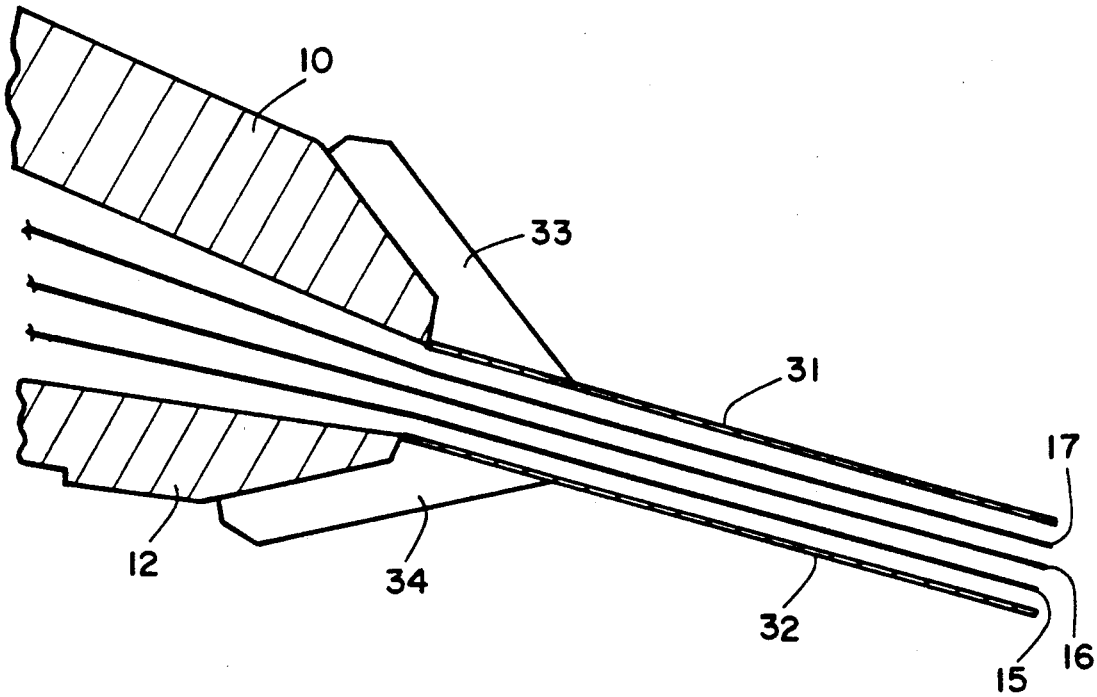
FIG. 3 is a cross-sectional view of a multiple channel headbox in accordance with this invention having headbox lip extensions coterminous with the adjacent extended headbox dividers.

FIG. 3 is a preferred embodiment of a headbox in accordance with this invention. In particular, shown is the upper headbox wall 10, the lower headbox wall 12, and extended dividers 15, 16, and 17. Also shown are flexible headbox lip extensions 31 and 32 which are coterminous with the headbox dividers. The headbox lip extensions can be attached to the headbox by any suitable means, but in the embodiment shown they abut the headbox lips and are supported by an upper support 33 and a lower support 34. Compared to designing the headbox with rigid walls which become parallel to the internal dividers (which is also within the scope of this invention), this embodiment is preferred because of its versatility for use in retrofitting existing headboxes and its thinner profile which enables placement of the headbox closer to the forming zone.

EXAMPLES

In order to illustrate the effectiveness of the method and headbox of this invention, the uniformity and purity of eight different three-layered tissue samples made on a twin wire former were compared. The center stock layers of the tissues comprised a 50/50 blend by weight of northern softwood kraft pulp (primarily spruce) and northern hardwood kraft pulp (primarily aspen), while each outer stock layer comprised a 50/50 blend by weight of eucalyptus pulp and the same northern softwood pulp. To enhance visual perception of layer uniformity and purity, the fibers in each outer layer were dyed blue and the fibers in each center layer were dyed orange. In all cases the tissue sheets were formed, dried and creped at 3200 feet per minute and thereafter visually compared for outer layer uniformity based on the ability to observe orange fibers in the outer surfaces. The four cases are summarized in the table below (basis weights expressed as pounds per 2880 square feet). In each case, the tissues were made without the headbox lip extensions and, for comparison, with headbox lip extensions (6 inch extensions, both top and bottom).

| | Extended Dividers | Basis Weight | Form Roll |
|---|---|---|---|
| Case #1 | Three, 6 inches | 10 | Solid |
| Case #2 | Two, 6 inches | 10 | Solid |
| Case #3 | Two, 2 inches | 10 | Solid |
| Case #4 | Three, 6 inches | 17 | Suction |

Figure 4A:
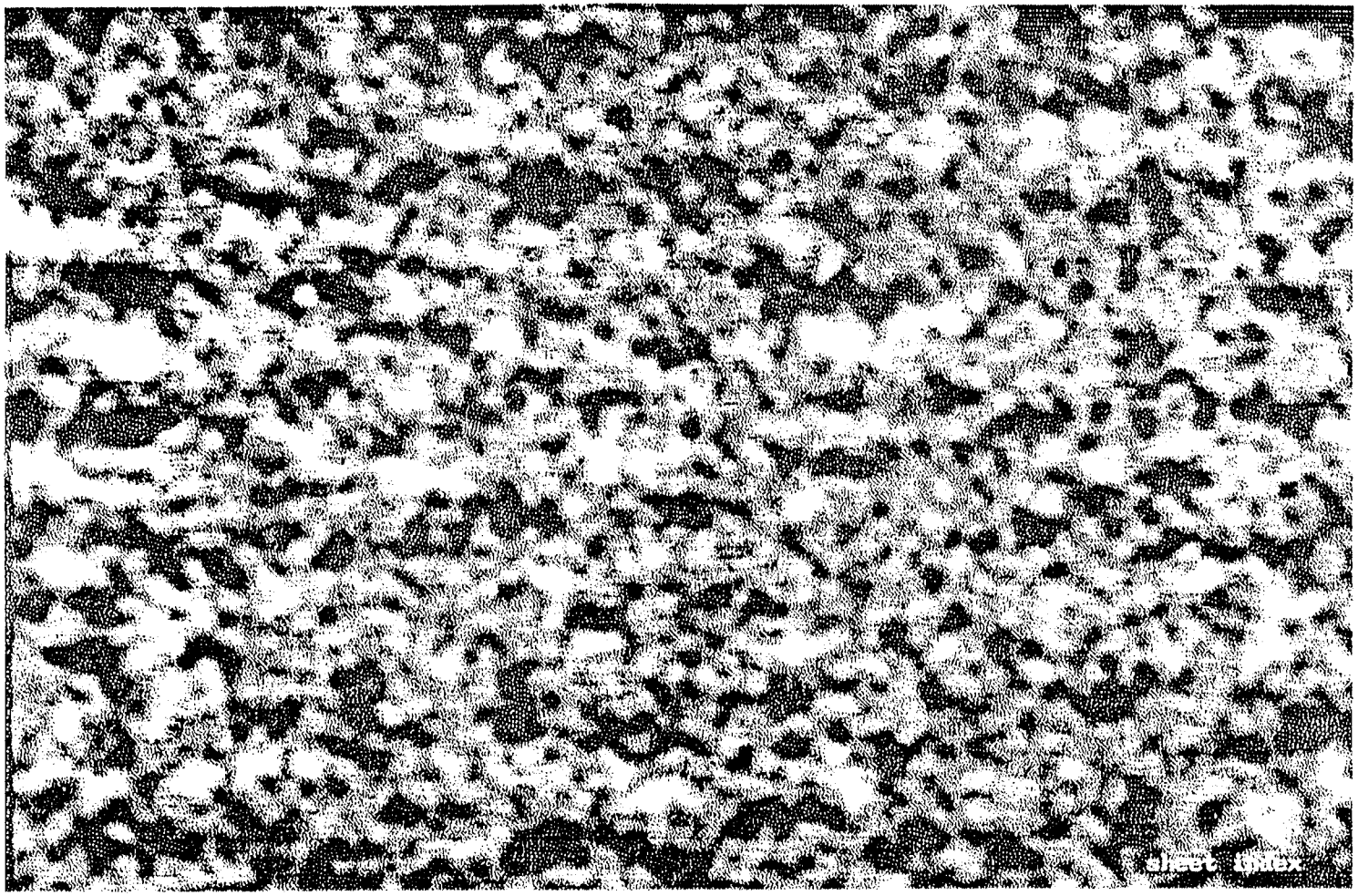
FIG. 4A is a black and white digital image, produced by a digital image analyzer, of tissue made in a conventional manner with a headbox having three extended (6 inches) headbox dividers, but without the headbox lip extensions of this invention. White areas represent fibers from the center layers of the tissue which are exposed on the surface of the tissue. (See Examples.)
Figure 4B:
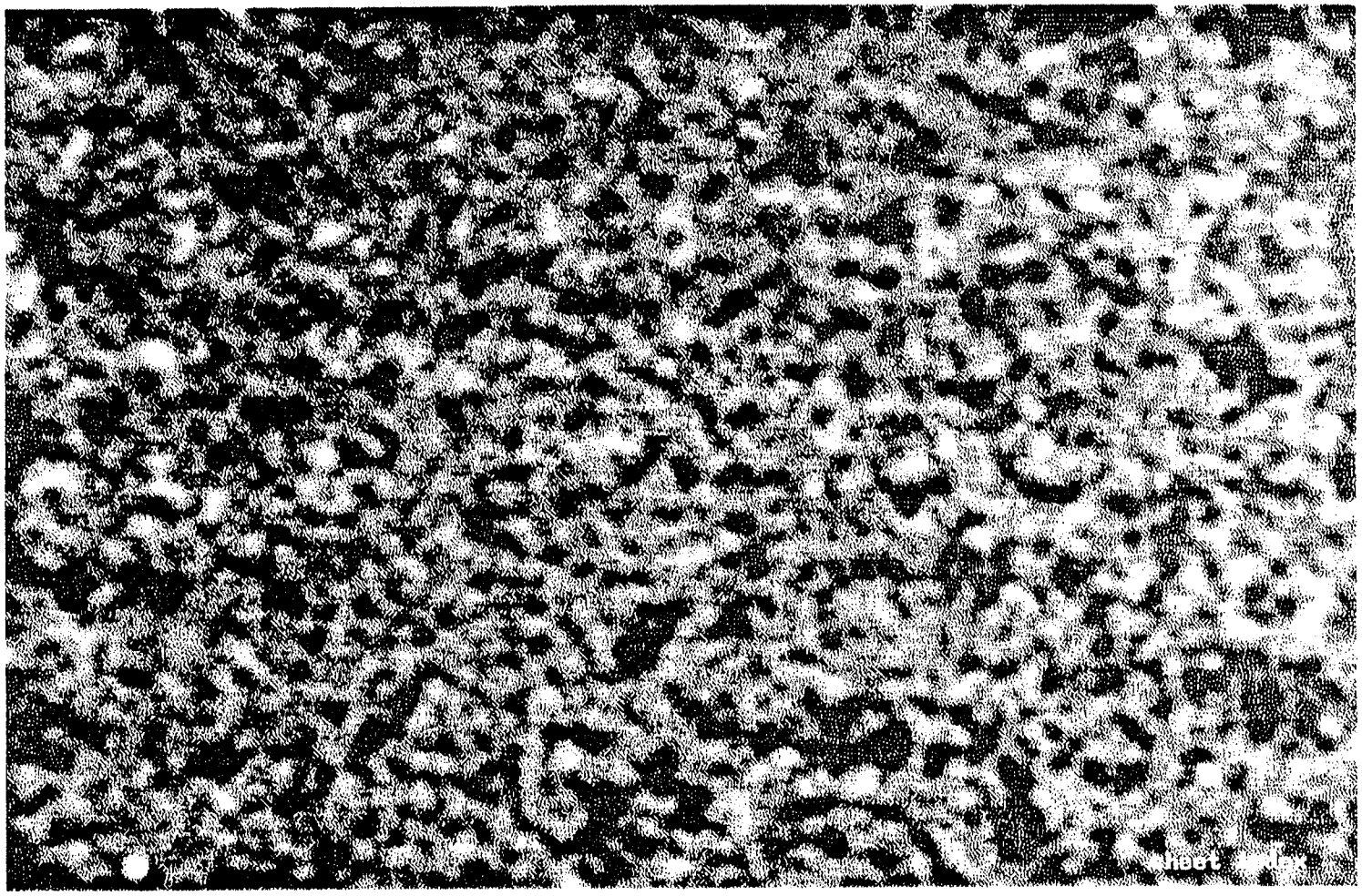
FIG. 4B is a black and white digital image of a tissue made in accordance with this invention using a headbox having three extended (6 inches) headbox dividers and two headbox lip extensions (6 inches). Note the decrease in white areas compared to FIG. 4A.

In each case, the tissues made in accordance with this invention using headbox lip extensions had improved outer layer uniformity as evidenced by fewer and smaller orange blotches and streaks appearing in the outer surfaces. As an example, the effect on the appearance of the tissue for Case #4 is shown in FIGS. 4A and 4B, where a digital image analyzer has been used to map blue areas to black and orange areas to white for illustration. Penetration of the orange (light areas of the digital image) is substantially reduced with the use of the headbox lip extensions as shown in FIG. 4B.

To confirm the results described above, the contamination of the roll side outer layer by aspen fibers from the center layer was quantified by measuring the quantity of aspen fibers in the outer layer. The fraction of aspen fibers in the roll side layer, expressed as weight percent aspen fibers per weight percent aspen fibers plus eucalyptus fibers, was compared in sheets made with and without headbox lip extensions of this invention for all four cases described above. In all four cases, the penetration of center layer aspen fibers into the roll side outer layer was reduced from about 10 to about 25 percent by using the headbox lip extensions in accordance with this invention.

It will be appreciated that the foregoing description of this invention, given for purposes of illustration, is not to be construed as limiting the scope of this invention, which is intended to include all equivalents thereto.

I claim:

1. A method for forming a layered paper web comprising issuing a layered stream of papermaking fibers from a multiple channel headbox with converging rigid headbox lips into a forming zone, wherein immediately prior to leaving the headbox, each of the two outermost layers of the layered stream of papermaking fibers is confined between a pair of substantially parallel surfaces, wherein each pair of parallel surfaces is an extended headbox divider and a flexible headbox lip extension which is attached to a respective rigid headbox lip.

2. The method of claim 1 wherein the extended headbox dividers and the flexible headbox lip extensions are substantially coterminous.

3. A method for forming a layered tissue web using a multiple channel headbox having sidewalls terminating at converging rigid headbox lips and having a slice opening between the headbox lips, said method comprising issuing a layered stream of papermaking fibers from the slice opening of the headbox into a forming zone defined in part by converging forming wires, wherein each of the two outermost layers of the stream of papermaking fibers is confined between a flexible extended headbox divider and a flexible headbox lip extension which is attached to a respective rigid headbox lip and is substantially parallel to the flexible extended headbox divider.

4. The method of claim 3 wherein the extended headbox divider(s) and the flexible headbox lip extensions extend from about 6 to about 12 inches from the headbox slice opening.

5. The method of claim 3 wherein the flexible headbox lip extensions and the extended headbox divider(s) are substantially coterminous.

6. In a multiple channel headbox for making layered paper, said headbox comprising sidewalls terminating at converging rigid headbox lips and having converging channels terminating at the headbox lips, the improvement comprising at least one flexible headbox divider in said headbox which extends beyond the headbox lips and two flexible headbox lip extensions each attached to a respective rigid headbox lip and extending parallel to and at least about as far as the extended headbox divider.

7. The headbox of claim 6 wherein the headbox lip extensions extend from about 6 to about 12 inches beyond the headbox lips.

8. The headbox of claim 6 wherein the headbox lip extensions are longer than the extended headbox divider(s).

9. The headbox of claim 6 wherein the headbox lip extensions are substantially coterminous with the extended headbox divider(s).

* * * * *